US006651724B1

(12) United States Patent
Cittadini

(10) Patent No.: US 6,651,724 B1
(45) Date of Patent: Nov. 25, 2003

(54) FOLDING BLINDS FOR WINDOWS AND DOORS

(76) Inventor: Antonio Cittadini, Carducci 15, Castelfidardo (AN) (IT)

( * ) Notice: Subject to any disclaimer, the term of this patent is extended or adjusted under 35 U.S.C. 154(b) by 0 days.

(21) Appl. No.: 10/018,891

(22) PCT Filed: Jun. 28, 2000

(86) PCT No.: PCT/IT00/00264

§ 371 (c)(1),
(2), (4) Date: Dec. 26, 2001

(87) PCT Pub. No.: WO01/02686

PCT Pub. Date: Jan. 11, 2001

(30) Foreign Application Priority Data

Jul. 1, 1999 (IT) ..... AN99A0031

(51) Int. Cl.[7] ..... E05D 15/26
(52) U.S. Cl. ..... 160/207; 160/36
(58) Field of Search ..... 160/207, 213, 160/206, 188, 37, 32, 33, 35, 36

(56) References Cited

U.S. PATENT DOCUMENTS 749,966 A * 1/1904 Jarrett ..... 160/169
2,179,882 A * 11/1939 Durre ..... 160/169
3,618,656 A * 11/1971 Young ..... 160/9
3,717,195 A * 2/1973 Larranaga ..... 160/169
4,303,117 A * 12/1981 Lindbergh ..... 160/189
4,374,537 A * 2/1983 Lindbergh ..... 160/189
4,846,245 A * 7/1989 Pagliaro et al. ..... 160/207
5,893,403 A * 4/1999 Megens ..... 160/35
5,957,181 A * 9/1999 Cohen-Ravid et al. ..... 160/32
6,035,917 A * 3/2000 Cohen-Ravid ..... 160/35

FOREIGN PATENT DOCUMENTS

DE 212568 * 8/1909
DE 9403992 * 5/1994
WO 9745615 * 12/1997

* cited by examiner

*Primary Examiner*—Blair M. Johnson
(74) *Attorney, Agent, or Firm*—Breiner & Breiner, L.L.C.

(57) ABSTRACT

This invention relates to a bellows folding blind for windows and doors, comprising a number of horizontal slats connected among to each other by means of adequate joints which, when the blind is raised enable the slats to automatically fold like an accordion inside the box. On each slat are applied three pins which are engaged by the teeth of the cams whose rotation allows the raising and lowering of the blind. The helicoidal screws synchronised with the cams engage the longer pin and allow the supporting, raising and lowering of the package of horizontal slats inside the box.

4 Claims, 3 Drawing Sheets

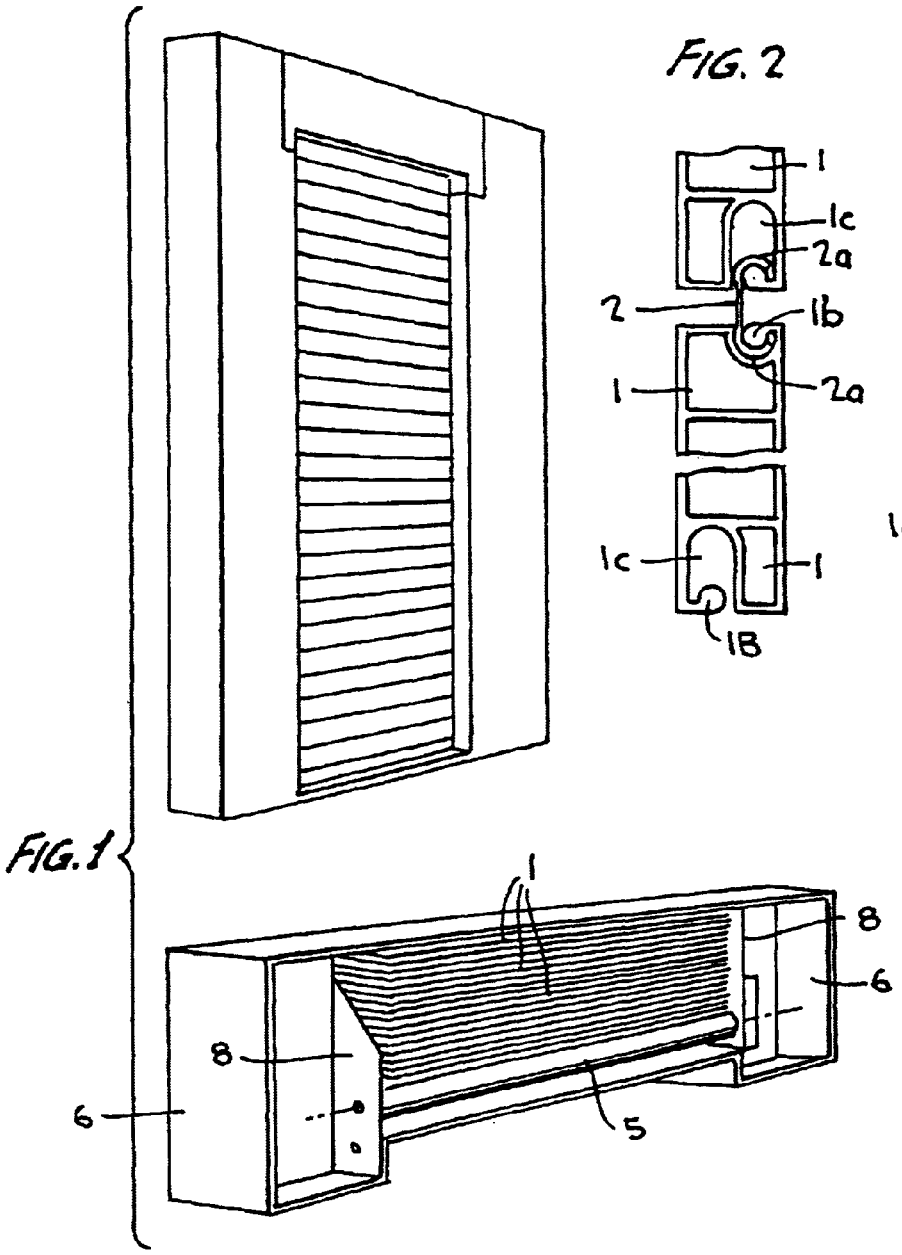
FIG. 1
1
8
6
8
6
5
FIG. 2
1
1c
2a
2
1b
1
2a
1c
1
1B
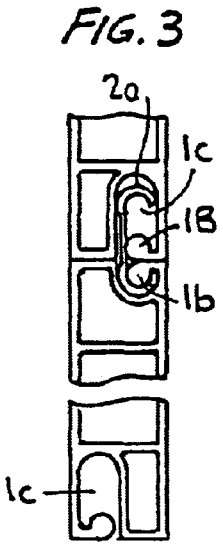
FIG. 3
2a
1c
1B
1b
1c
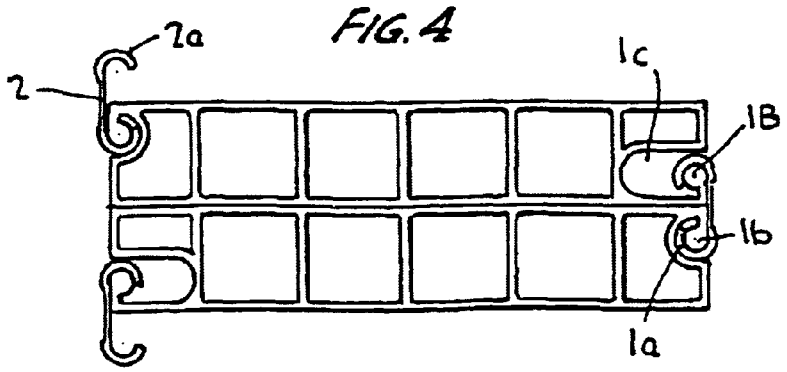
FIG. 4
2a
2
1c
1B
1b
1a 13b
13a
3b
3c
3a
3a
12
8b
8c
11b
8a
11a
5
10
9
7a
1
1
7

13b
3a
12
3b
3c
5
9
1
1
7
1

FOLDING BLINDS FOR WINDOWS AND DOORS

TECHNICAL FIELD

This patent application for industrial invention concerns a folding blind for windows and doors.

BACKGROUND OF ART

As it is well known, blinds for windows and doors, one type being commonly known as rolling shutter and the other as roller blind have been till now rolling devices made up by a series of horizontal slats, connected to each other by means of appropriate joints that enable them to sway with respect to each other so that they can spiral around an horizontal spindle whose rotation can be driven either manually by means of belts or automatically by means of an electric motor. The upper slat is made integral with such spindle on which the whole weight of the blind is discharged, and in fact the spindle rests on heavy supports, permanently fixed to the wall.

One of the drawbacks of rolling shutters and roller blinds is represented by the complexity of installation, that requires a double work of masonry: the first to fix the supports of the spindle, and the second to fix the wooden box, with which is plugged the spindle well.

Another drawback of rolling shutters is due to their crosswise volume when completely rolled, namely when they are completely wrapped around their spindle. Such volume is almost always greater than the depth of the well into which the blind is to be housed, and therefore such box inevitably props up with respect to the inner face of the wall, thus determining two types of drawbacks: the first of a purely aesthetic nature and the second of a technical nature, consisting in the fact that the curtains have to be put at a certain distance from the wall, which increases according to the jut of the box, since the curtains are usually mounted on a surface facing the box, so that the latter can be covered and hidden by the curtains themselves.

All this practically determines a loss in the useful surface of the room with respect to the cases in which the curtains can be positioned close to the wall.

The aim of this invention is to conceive a blind for windows and doors that, at its maximum compaction, i.e. when the blind is completely raised, may have a crosswise volume remarkably lower than that of existing folding blinds and in any case such as not to overcome the depth of the box well in which they are contained, so that their housing and covering box can stay perfectly flush with respect to the inner face of the wall.

Another aim of this invention is to conceive a blind for windows and doors whose components can be installed and supported within its housing and covering box, so that the installation can be easier and faster, consisting in simply inserting and anchoring the box into the appropriate well.

Over the years, a certain number of devices were conceived to find a solution to the above described drawbacks: the patent DE A 29 47501 describes for instance a folding blind for windows and doors whose slats are articulated among them by means of a curved-end joint, and equipped with pins at the ends of the slats; the pins run within two lateral slideways (17,18) and a gearwheel, driven by a motor or a belt, engages the pins and pushes open or closed the slats; when they are opened, the slats should arrange like an accordion. In the above patent the slideways run from the base of the blind to the lower face of the gearwheel, and therefore the slats have no runner above the gearwheel. This entices a not ordered arrangement of the slats that impairs the operation of the blind. As suggested by the drawings annexed to the documentation, the above said blind could at best be suitable for roof lights, where the almost vertical arrangement of the blind may help the slats arrange as desired. In case of vertical placement of the blind, the probability that the slats arrange themselves in the right way is almost nil; in fact, in a variant described and illustrated in the patent, the slats are wrapped around a pin, thus thwarting the advantages of a folding accordion-like blind. The U.S. Pat. No. 4, 303,117 describes an opening and closing device for accordion-like blinds in which the slats, equipped with lateral pins, run within two slideways and are provided with weights that, making them heavier, enable them to be lowered; the slats are raised applying the power to two ropes connected to the lowest slat: the slats are bent by means of two ropes and two cams which are also required to overcome the peak load existing in the joints, since the raising cables hold the slat arrangement tightened both when raised and when lowered; in order to facilitate the movement of the blind, a system of counterweights is required. The system described in the U.S. Pat. No. 4,303,117 is rather complex, costly and, when moving the blind, it causes several frictions due to the sliding of ropes, to devices 25 and 26 which induce bending of panels, to the friction deriving from counterweights; moreover the system described in such patent remarkably increases the weight to be raised and its motion is not perfectly uniform, due to the counterweights.

Also the Italian Patent no. 01286983-PCT/IT/00120 conceived an accordion-like folding blind that during realisation created problems when operating, since the package of slats above the cam was not adequately guided and supported.

DISCLOSURE OF INVENTION

This invention consists in a blind for windows and doors which, besides being capable of being installed within boxes of small dimensions owing to the accordion-like bending of slats, may also remove the above mentioned drawbacks by means of a safe bending of slats thanks to a simple mechanism providing minimum weight and friction, with adequate sideways and safe support of the package of slats above the cam.

These objectives have been reached thanks to the subject blind which includes a series of horizontal slats connected to each other by means of adequate joints which enable, when the the blind is raised, an automatic bellows closing of the slats as they enter the box. The crosswise volume of such blind, inside, practically corresponds to the width of a slat, since all the slats rest exactly one above the other, thus forming a stack of constant width, independently from the number of slats forming the blind, contrary to what happens with rolling blinds, whose spiral has a diameter which increases with the number of slats that compose the blind.

The upper slat is free and when completely raised, it is in contact with the upper part of the box, while when completely lowered it rests above the cam, in order to reduce the overall height of the slat panel.

Raising and lowering are obtained through the rotation of two centric circular toothed cams that engage the pins of the slats, thus determining upwards and downwards drive. The two lateral cams are driven either manually through a belt or automatically through a series of gearwheels connected by means of a transmission spindle; gearwheels are housed within a metal box, having the required dimensions, and suitable to support the strength for raising and lowering the slat panel, and all this is housed inside the wall box. Since the spindle has not to support the weight of the blind, the relative supports may safely be fixed to the walls of the box, that in this way will contain the blind and all its operating mechanisms.

This means that the installation of such blind may be done in only one phase, during which the box, and the blind inside it, are inserted and embedded in the appropriate opening of the wall.

BRIEF DESCRIPTION OF THE DRAWINGS

In order to clarify explanation, this description continues with reference to the annexed drawings, which have only an illustrative and not a restrictive value, and where:

FIG. 1 shows in a perspective and schematic representation the blind compressed within its box;

FIG. 2, 3 and 4 show respectively a couple of slats when in coplanar and detached position, coplanar and close position, overlapping position, one settled on the other.

FIG. 6 is a view of FIG. 5 folded accordion-like;

DESCRIPTION OF THE PREFERRED EMBODIMENT

With reference to the above figures, the blind is made up by a series of connected slats (1) linked together by means a flat section (2) with longitudinal hook-like bent sides (2*a*), engaged by means of appropriate loops along the longitudinal sides of each slat. In particular, on the upper side of each slat (1) there is a longitudinal loop (1*a*) having a semicircular profile developing around a round longitudinal rib (1*b*) with which the lower side of the section (2) is engaged, while on the lower side of each slat (1) there is a deep longitudinal loop (1*c*) almost rectangular in its shape, on whose mouth is envisaged a round longitudinal rib (1B) corresponding to the one above (1*b*) and to which is engaged the hook-like side of the section (2).

The depth of the loop (1*c*) is such that the latter may house a part of section (2) when two slats (1) arranged on their edge in coplanar position arrive directly in contact between them, as indicated in FIG. 3.

It should be pointed out that the loops (1*a* and 1*c*) are not in the same position with respect to the centre and are placed in opposed position on each slat (1) and therefore the slats (1) have to be connected in alternate position so that the upper loop (1*c*) of one may be interfaced with the lower loop (1*a*) of the immediately overhanging slat (1). Over each end of the slats (1) three pins are applied (3*a*, 3*b* and 3*c*) which are used to engage the slat (1) by the cam (9) for raising and lowering; outside the box, the slats (1) are superimposed to each other edgewise.

Figure 6:
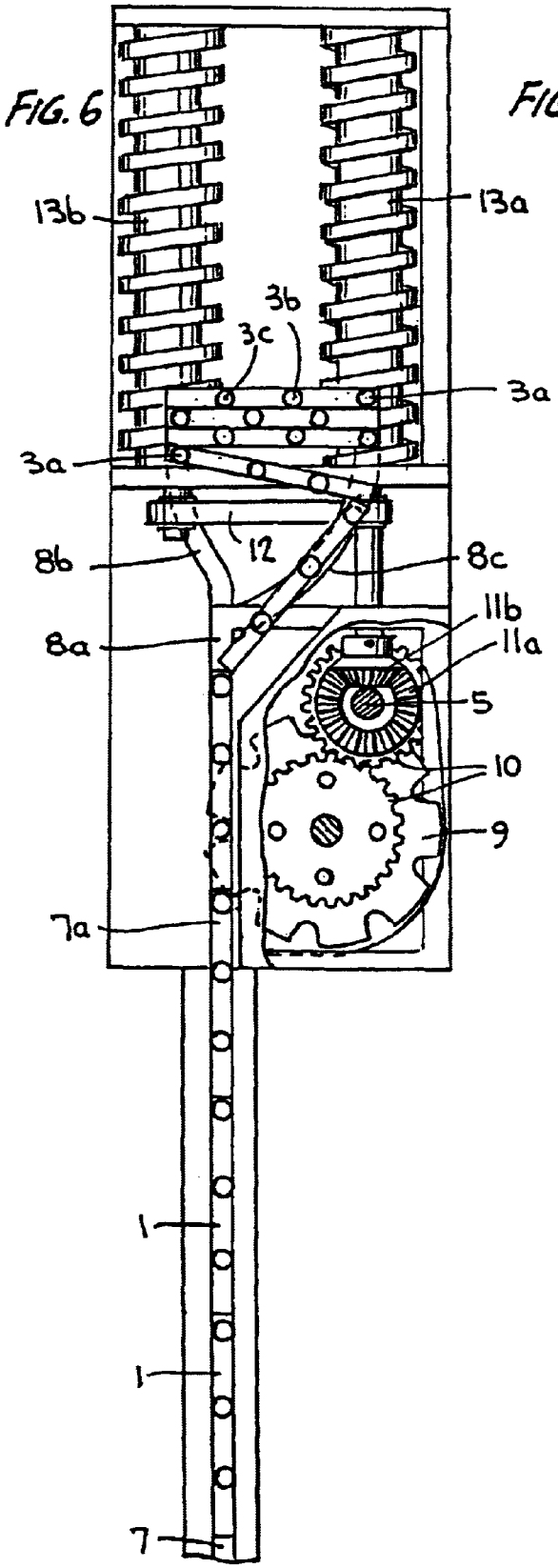
Figure 5:
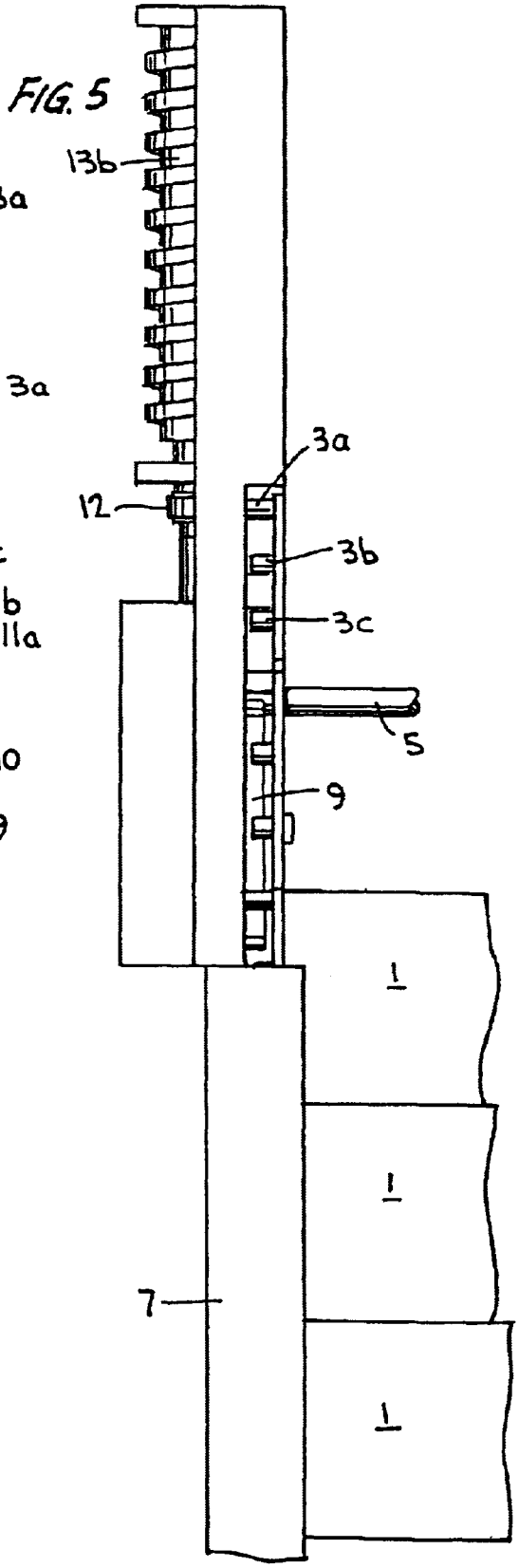
FIG. 5 is a schematic view of the left end of the box.

Inside the box (6) the slats (1) are closed accordion-like, lying on each other, forced in such position by the hoist of cams (9) and by the slideways (8*a*, 8*b* and 8*c*) and by the pin (3*a*) which is longer than pins (3*b* and 3*c*), housed into the respective metal box (8). With reference to FIG. 6, the upright slideways (7) in which the slats (1) run, have an appropriate seat (7*a*) for housing and sliding of pins (3*a*, 3*b* and 3*c*).

Inside the box (6) besides the cams (9) the transmission spindle (5) and appropriate slideways are envisaged (8*a*, 8*b* and 8*c*), anchored to the inner face of the two boxes (8). To be more precise, on both the left and right sides of the box (6) and close to the slats (1) and to the cams (9), a slideway (8*a*) is realised, whose lower part is intercommunicating with the seats (7*a*) of the upright slideways (7), since the above slideway is intended to receive the pins (3*a*) as the slats (1) are gathered within the box (6).

On the inner part of each box (8), as it has been said, a slideway is realised, which at a certain height, compatible with the folding of slats (1) is divided into two wings (8*b* and 8*c*) to enable the passage of pins (3*a*) while the package of slats (1), the cams (9) and the pins (3*b* and 3*c*) remain outside.

Into the air space of each box (8) are located and protected the gearwheels (10 and 11) that may act as a reduction gear.

The slideway (8*a* and its wings 8*b* and 8*c*), less deep than the slideway (7 and 7*a*), realised on the inner part of the box (8), must have dimensions that enable the slats (1) to be folded in pairs and unfolded in pairs owing to the pin (3*a*).

On the outer part of one of the boxes, namely on the face opposite to the slideway (8*a*) is anchored the spindle (5) which activates the blind.

In order to enable the support of the horizontal package of slats (1) which is formed in the point where the two arms of the slideways (8*b* and 8*c*) become parallel and vertical, to prevent their uncontrolled fall and uniform raising and lowering, two helicoidal screws (13*a* and 13*b*) are vertically mounted within the box, synchronised with the movement of the cam (9), having the function to support, raise and lower the horizontally positioned slats (1), by hooking the respective pins (3*a*). The synchronism is transmitted to the helicoidal screw (13*b*) by the screw (13*a*) by means of a toothed belt (12).

Figure 8:
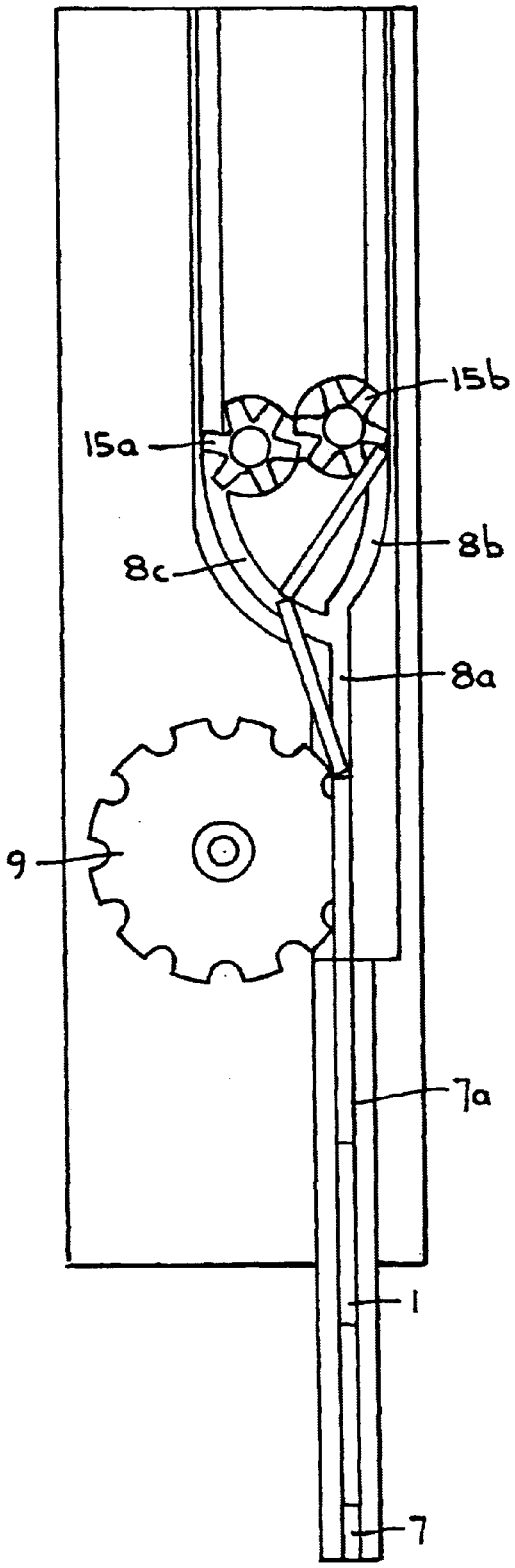
FIG. 8 is a view of FIG. 7 from left to right, containing the two upper slats during the bending phase.
Figure 7:
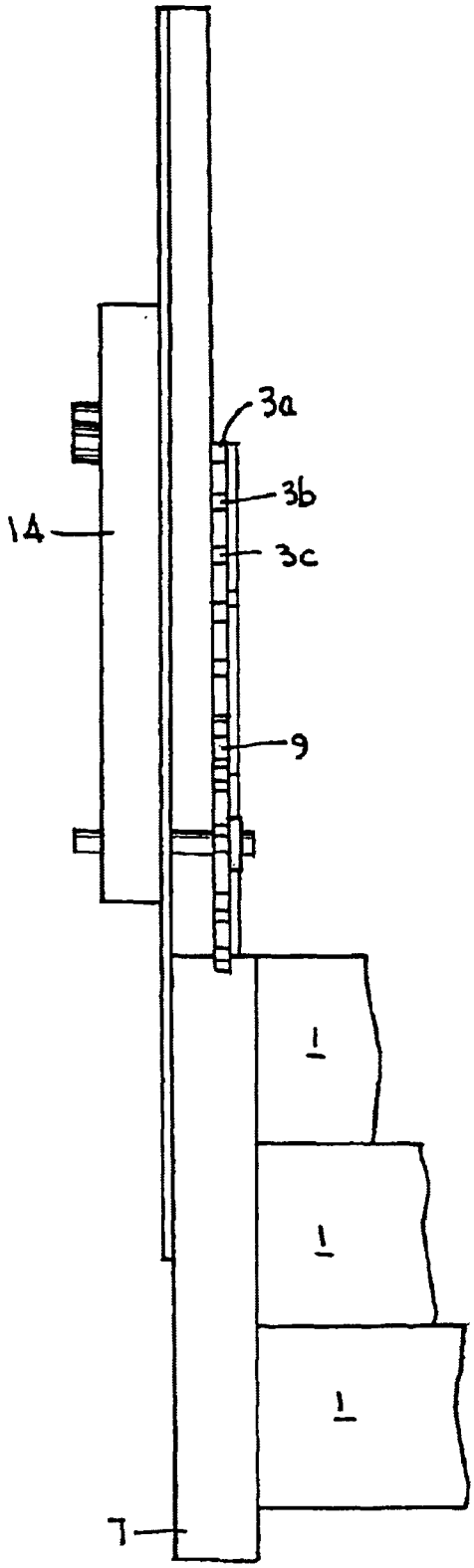
FIG. 7 is a schematic view of the left end of the box having a simpler support system fort the panel of slats.

As it has been said, the package of slats (1) according to the direction of rotation of the two helicoidal screws (13*a* and 13*b*) which hook the pins (3*a*) of respective slats (1) is lfted or lowered, since each slat is hooked by means of its pin (3*a*) its weight is discharged on the tooth of the helicoidal screw (13*a* or 13*b*), and this enables an even distribution of the weight of the package, slat by slat. As an alternative to the synchronised system cam (9)—helicoidal screws (13*a* and 13*b*) for supprt, raiseing and lowering of the package of slats (1), a simpler system was devised, as described in FIG. 7 and 8, using the same slats (1), the same pins (3*a* 3*b* and 3*c*), the same cam (9) having recourse to the synchronism cam (9)—cams (15*a* and 15*b*) which hook the pins (3*a*) of the respective slats. The synchronism is realised through circular toothed wheels placed inside the casing (14). Other systems for supporting, raising and lowering the package of slats (1) can be realised with drive chain systems.

What is claimed is:

1. Folding blinds for windows and doors comprising:

a box, said box having two ends, a transmission spindle connected to each of said two ends of said box, two cams, wherein one of said two cams is present in each of said two ends of said box, one or more gearwheels in operation with each of said two cams, a series of slats, each of said series of slats comprising a first side and a second side, said first side having an upper longitudinal loop therein and said second side having a lower longitudinal loop therein, and three pins on each of a first end and a second end, respective wherein said three pins on said first end and said second end serve respectively as hooks for said one of said two cams present on each of said two ends of said box, a plurality of flat sections wherein each flat section has a first hook-like side and a second hook-like side, wherein said first hook-like side of said each flat section hooks said upper longitudinal loop of said first side of one of said series of slats, and said second hook-like side hooks said lower longitudinal loop of said second side of an adjacent slat, a slideway operatively positioned to each of said two cams, each said slideway bifurcating into a first arm and a second arm, said slideway housing a first pin of said three pins of said each slat, wherein said first arm is adapted to receive said first pin of a first slat of said series of slats and said second arm is adapted to receive said first pin of a slat succeeding said first slat of said series of slats, such that successive first pins of said series of slats alternate between being received in said first arm and received in said second arm of said slideway, and two helicoidal screws wherein each of said two helicoidal screws is vertically mounted in each of said two ends of said box with one end of said two screws being at a level where said first arm and said second arm of said slideway take a parallel and vertical shape to said two helicoidal screws, said two helicoidal screws being synchronized respectively with movement of said one of said two cams present in each of said two ends of said box in order to support, raise or lower horizontally positioned slats of said series of slats by hooking first pins of said slats.

2. Folding blinds for windows and doors according to claim 1, wherein said upper longitudinal loop has a substantially semicircular profile with a longitudinal rib, and said lower longitudinal loop has a substantially rectangular profile with a longitudinal rib, wherein said longitudinal rib of said lower longitudinal loop and said longitudinal rib of said upper longitudinal loop hold said first hook-like side and said second hook-like side of said flat sections respectively, and wherein each said lower longitudinal loop has a depth that can house a part of one of said flat sections when said series of slats are arranged in a coplanar position.

3. Folding blinds for windows and doors comprising:

a box, said box having two ends, a transmission spindle connected to each of said two ends of said box, two cams, wherein one of said two cams is present in each of said two ends of said box, one or more gearwheels in operation with each of said two cams, a series of slats, each of said series of slats comprising a first side and a second side, said first side having an upper longitudinal loop therein and said second side having a lower longitudinal loop therein, and three pins on each of a first end and a second end, respect wherein said three pins on said first end and said second end serve respectively as hooks for said one of said two cams present on each of said two ends of said box, a plurality of flat sections wherein each flat section has a first hook-like side and a second hook-like side, wherein said first hook-like side of said each flat section hooks said upper longitudinal loop of said first side of one of said series of slats, and said second hook-side of an adjacent slat, a slideway operatively positioned to each of said two cams, each said slideway bifurcating into a first arm and a second arm, said slideway housing a first pin of said three pins of said each slat, wherein said first arm is adapted to receive said first pin of a first slat of said series of slats and said second arm is adapted to receive said first pin of a slat succeeding said first slat of said series of slats, such that successive first pins of said series of slats alternate between being received in said first arm and received in said second arm of said slideway, and two circular toothed cams mounted in said box at a level approximate where said first arm and said second arm of said slideway take a parallel and vertical shape, said two circular toothed cams being synchronized respectively with movement of said one cam present in each of said two ends of said box in order to support, raise or lower said series of slats by hooking respective first pins of slats of said series of slats.

4. Folding blinds for windows and doors according to claim 3, wherein said upper longitudinal loop has a substantially semicircular profile with a longitudinal rib, and said lower longitudinal loop has a substantially rectangular profile with a longitudinal rib, wherein said longitudinal rib of said lower longitudinal loop and said longitudinal rib of said upper longitudinal loop hold said first hook-like side and said second hook-like side of said flat sections respectively, and wherein each said lower longitudinal loop has a depth that can house a part of one of said flat sections when said series of slats are arranged in a coplanar position.

* * * * *